US012473707B2

(12) United States Patent
Mc Neil et al.

(10) Patent No.: US 12,473,707 B2
(45) Date of Patent: Nov. 18, 2025

(54) MATERIAL HANDLER SKIP PAN

(71) Applicant: MODERN FABRICATION INC., Shanty Bay (CA)

(72) Inventors: Jason Mc Neil, St-Christophe-d'arthabaska (CA); Andrew Guitar, Elmvale (CA); Mark Vanderzyde, Barrie (CA); Mark Vandenberg, Oro-Medonte (CA)

(73) Assignee: MODERN FABRICATION INC., Shanty Bay (CA)

( * ) Notice: Subject to any disclaimer, the term of this patent is extended or adjusted under 35 U.S.C. 154(b) by 931 days.

(21) Appl. No.: 17/685,854

(22) Filed: Mar. 3, 2022

(65) Prior Publication Data

US 2022/0282447 A1 Sep. 8, 2022

Related U.S. Application Data

(60) Provisional application No. 63/155,981, filed on Mar. 3, 2021.

(51) Int. Cl.
*E02F 3/40* (2006.01)
*E02F 3/30* (2006.01)
(Continued)

(52) U.S. Cl.
CPC ..... *E02F 3/407* (2013.01); *E02F 3/308* (2013.01); *E02F 3/425* (2013.01)

(58) Field of Classification Search
CPC ... E02F 3/40; E02F 3/407; E02F 3/308; E02F 3/425; E02F 3/3681; B66C 3/00; B66C 13/08; B66C 23/00; B66C 23/52
(Continued)

(56) References Cited

U.S. PATENT DOCUMENTS 978,540 A * 12/1910 Barnett ..... E02F 3/304 414/692
2,120,444 A * 6/1938 Smith ..... E02F 5/006 37/395

(Continued)

FOREIGN PATENT DOCUMENTS

CN 201495570 U 6/2010
CN 207760907 U 8/2018

(Continued)

OTHER PUBLICATIONS

Modern Fabrication Inc., European Patent Application No. 22762296.6, Extended European Search Report, Jan. 21, 2025.

(Continued)

*Primary Examiner* — Jamie L McGowan
(74) *Attorney, Agent, or Firm* — Moore & Van Allen PLLC; Jeffrey R. Gray

(57) ABSTRACT

A skip pan for handling materials comprising a base of the skip pan for containing the materials. A portion of a contour thereof has walls and a remainder of the contour is a wall-less edge. A bridge holds the base and comprises, at the top, a connecting portion for connecting to an arm of a material handler. The connecting portion is rotatable along a vertical axis thereof to provide a spinning movement to the skip pan. The connecting portion is tiltable by the arm of the material handler. An actuator provides an adaptable inclination of the base of the skip pan with respect to the bridge to keep the base balanced when the connecting portion is tilted to avoid contents to slide by the wall-less edge during movement.

20 Claims, 8 Drawing Sheets

(51) Int. Cl.
*E02F 3/407* (2006.01)
*E02F 3/42* (2006.01)

(58) Field of Classification Search
USPC ..... 37/399, 396, 398, 397, 395; 414/140.3, 414/141.6, 561, 575, 692, 694, 700, 711, 414/712, 713, 743
See application file for complete search history.

(56) References Cited

U.S. PATENT DOCUMENTS 2,159,065 A * 5/1939 Weeks ..... E02F 3/60 294/68.26
2,669,042 A * 2/1954 Swank ..... E02F 3/60 37/398
2,798,758 A * 7/1957 Yakopec ..... B65D 88/56 220/765
3,115,258 A * 12/1963 Shackley ..... E02F 3/54 414/559
3,314,710 A * 4/1967 Edeburn ..... E02F 7/00 294/68.26
3,374,907 A * 3/1968 Phillips ..... B65D 88/56 294/68.27
3,606,438 A * 9/1971 Feczko ..... B66C 3/00 294/68.27
4,172,687 A * 10/1979 Schultz ..... E02F 3/40 414/724
4,295,677 A * 10/1981 Petrin ..... B66C 1/12 294/68.26
4,365,926 A * 12/1982 Brown ..... B66C 1/24 182/2.9
4,526,278 A * 7/1985 Hebert ..... B66C 1/24 212/242
4,955,972 A * 9/1990 LaBounty ..... B66C 3/00 294/67.2
4,958,981 A * 9/1990 Uchihashi ..... E02F 3/3677 414/723
5,641,188 A * 6/1997 Phillips ..... B66C 3/00 294/68.27
5,832,638 A * 11/1998 Watts ..... E02F 3/60 37/444
6,163,988 A * 12/2000 Pratt ..... E02F 3/3609 403/14
7,658,023 B2 * 2/2010 Wallett ..... F16F 9/18 188/312
8,950,091 B2 * 2/2015 Cover ..... E02F 9/2271 37/395
9,080,314 B1 * 7/2015 Rossi, Jr. ..... E02F 3/407
9,783,954 B1 * 10/2017 Justice ..... E02F 3/60
11,365,526 B2 * 6/2022 Kaatrasalo ..... B66C 3/005
2010/0294730 A1 * 11/2010 Weston ..... B07B 1/00 210/241
2013/0247426 A1 * 9/2013 Cover ..... E02F 9/2271 29/890.09
2016/0289919 A1 * 10/2016 Evans ..... E02F 9/123
2018/0187396 A1 * 7/2018 Sakamoto ..... F15B 11/00
2019/0119885 A1 * 4/2019 Kaatrasalo ..... E02F 3/3681
2024/0018743 A1 * 1/2024 Kjaergaard ..... E02F 3/437

FOREIGN PATENT DOCUMENTS

DE 10361583 A1 7/2005
EP 3748086 A1 12/2020
JP 2006232428 A 9/2006
JP 2019173362 A 10/2019

OTHER PUBLICATIONS

International Patent Application No. PCT/CA2022/050306, International Search Report and Written Opinion, Jun. 3, 2022.

* cited by examiner

MATERIAL HANDLER SKIP PAN

CROSS-REFERENCE TO RELATED APPLICATION

This application claims priority or benefit from U.S. provisional patent application 63/155,981 filed Mar. 3, 2021, which is hereby incorporated herein by reference in its entirety.

FIELD

The subject matter disclosed generally relates to implements, such as crane implements, for handling materials. More specifically, it relates a skip pan for handling loose materials such as steel scrap.

BACKGROUND

Piles of loose materials in bulk, such as materials to be recycled, metal scrap (including steel scrap) need to be transported to be transformed. Often, piles of such materials are loaded in trucks and unloaded in ships for transportation elsewhere.

In this context, it is common to use grapples which are provided at the end of a crane or other types of material handlers, as shown in FIG. 1, showing a prior-art material handler with a grapple.

The use of a grapple, comprising distinct fingers which can be contracted to grab contents and expanded to let go the contents, has its disadvantages since parts can be dropped from the grapple by falling from between the fingers, resulting in objects being dropped in water. For example, it can especially happen in a context where the is a pile of metal scrap in close vicinity to the water, such as on the pier, which can result in spilling in the water. Also, the volume to be handled by a grapple is relatively limited and the handling speed is low.

The grapple can be mounted on the crane of a boat, but it shares the same drawbacks as noted above.

As an alternative, in the prior art, a pan can be used to collect the materials, and the pan is then lifted using cables. This method is unsafe, as the pan can be unbalanced and the equilibrium provided by the cables while the pan is lifted and transported above the ship is fragile. Cable cranes are also difficult and expensive to maintain.

These issues need to be addressed by providing a safer alternative which would be faster, eco-friendlier and easier to operate.

BRIEF DESCRIPTION OF THE DRAWINGS

According an aspect, there is provided a skip pan for handling materials comprising:

- a base of the skip pan for containing the materials and having a portion of a contour thereof having walls;
- a bridge holding the base and connected at an upper end to a connecting portion for connecting to an arm of a material handler, wherein the connecting portion is rotatable along a vertical axis thereof to provide a spinning movement to the skip pan; and
- an actuator to provide an adaptable inclination of the base of the skip pan with respect to the bridge to keep the base balanced when the connecting portion is tilted.

Figure 1:
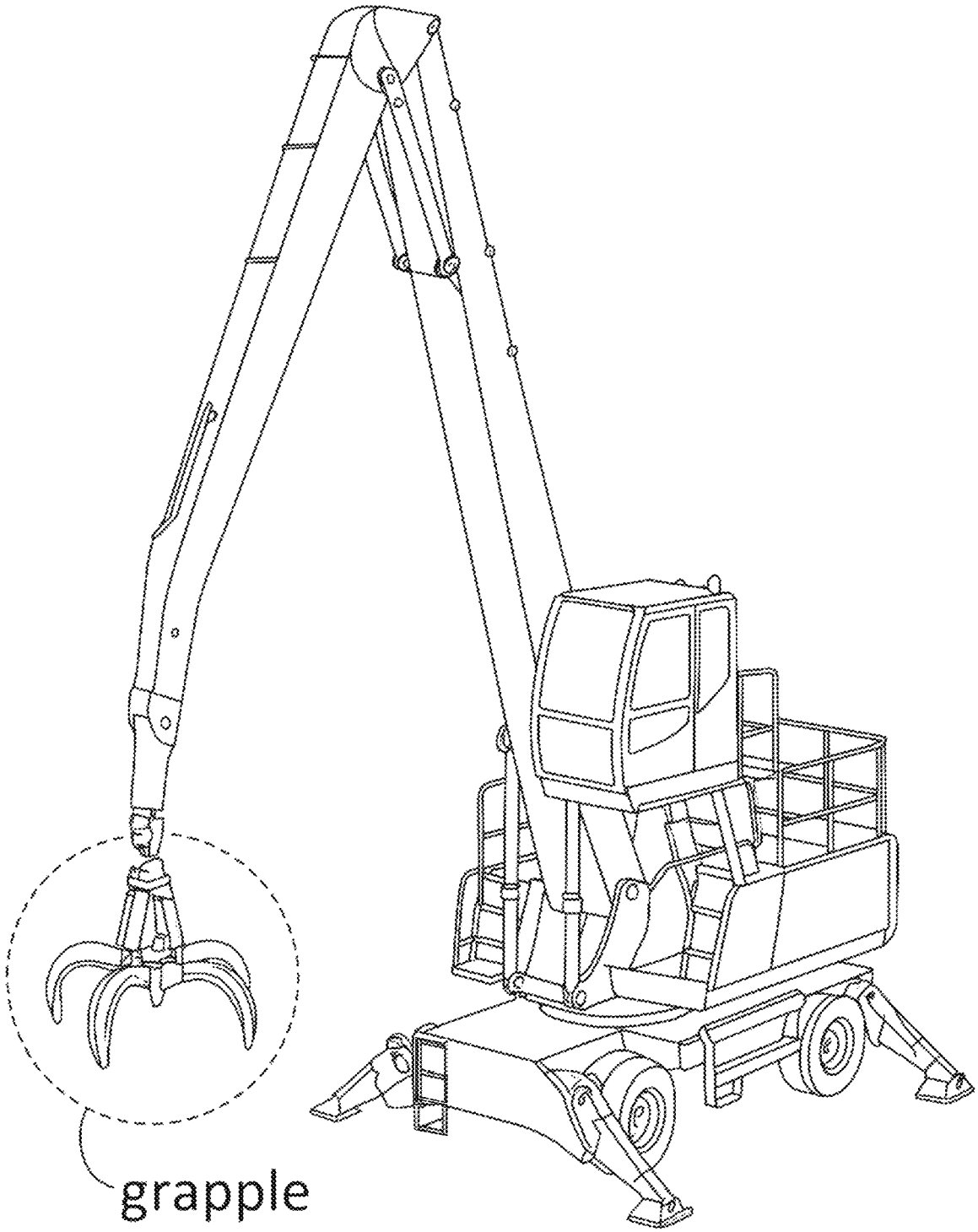
FIGURE 1 PRIOR ART

According to an embodiment, a remainder of the contour of the base of the skip pan has a wall-less edge.

According to an embodiment, the actuator provides the adaptable inclination of the base of the skip pan which moves the wall-less edge up or down.

According to an embodiment, the base of the skip pan has a surface for containing the materials which is flat and continuous.

According to an embodiment, the base of the skip pan has a contour with four sides, comprising a left-side one of the walls of the base, a right-side one of the walls of the base, a rear wall together forming said contour of the base having walls, a front side of the base forming the remainder of the contour of the base of the skip pan and being the wall-less edge.

According to an embodiment, the actuator comprises a left hydraulic cylinder connecting between the bridge and the left-side one of the walls of the base, and a right hydraulic cylinder connecting between the bridge and the right-side one of the walls of the base.

According to an embodiment, the bridge has a reverse U shape with lower arms connected with the base of the skip pan and forming a hinge connection therewith.

According to an embodiment, there are two lower arms of the bridge, each connected to a respective one of the left-side one of the walls of the base, and the right-side one of the walls of the base and forming a hinge connection therewith.

According to an embodiment, the hinge connection has a hinge axis which is substantially parallel with the wall-less edge.

According to an embodiment, the hinge axis is substantially perpendicular to the vertical axis of the connecting portion at the upper end of the bridge.

According to an embodiment, the actuator comprises cylinders which extend from an upper portion of the bridge to a portion of the base of the skip pan which is away from the hinge connection in a direction perpendicular to the hinge axis of the hinge connection to provide the adaptable inclination of the base of the skip pan with respect to the bridge around the hinge axis of the hinge connection.

According to an embodiment, the connecting portion at the upper end of the bridge comprises at least one of: hydraulic tubing and electrical connection passing therethrough to power the actuator of the skip pan.

According to an embodiment, the actuator comprises a hydraulic cylinder connecting between the bridge and a respective one of the walls of the base.

According to an embodiment, there is further provided a controller which controls the actuator to provide an adaptable inclination of the base of the skip pan with respect to the bridge to keep the base balanced when the connecting portion is tilted by the arm of a material handler.

According to an embodiment, the base of the skip pan comprises side bumps forming an abutment for corresponding portions of a truck to stop a truck entering into the skip pan at a position defined by said abutment

BRIEF DESCRIPTION OF THE DRAWINGS

Figure 2:
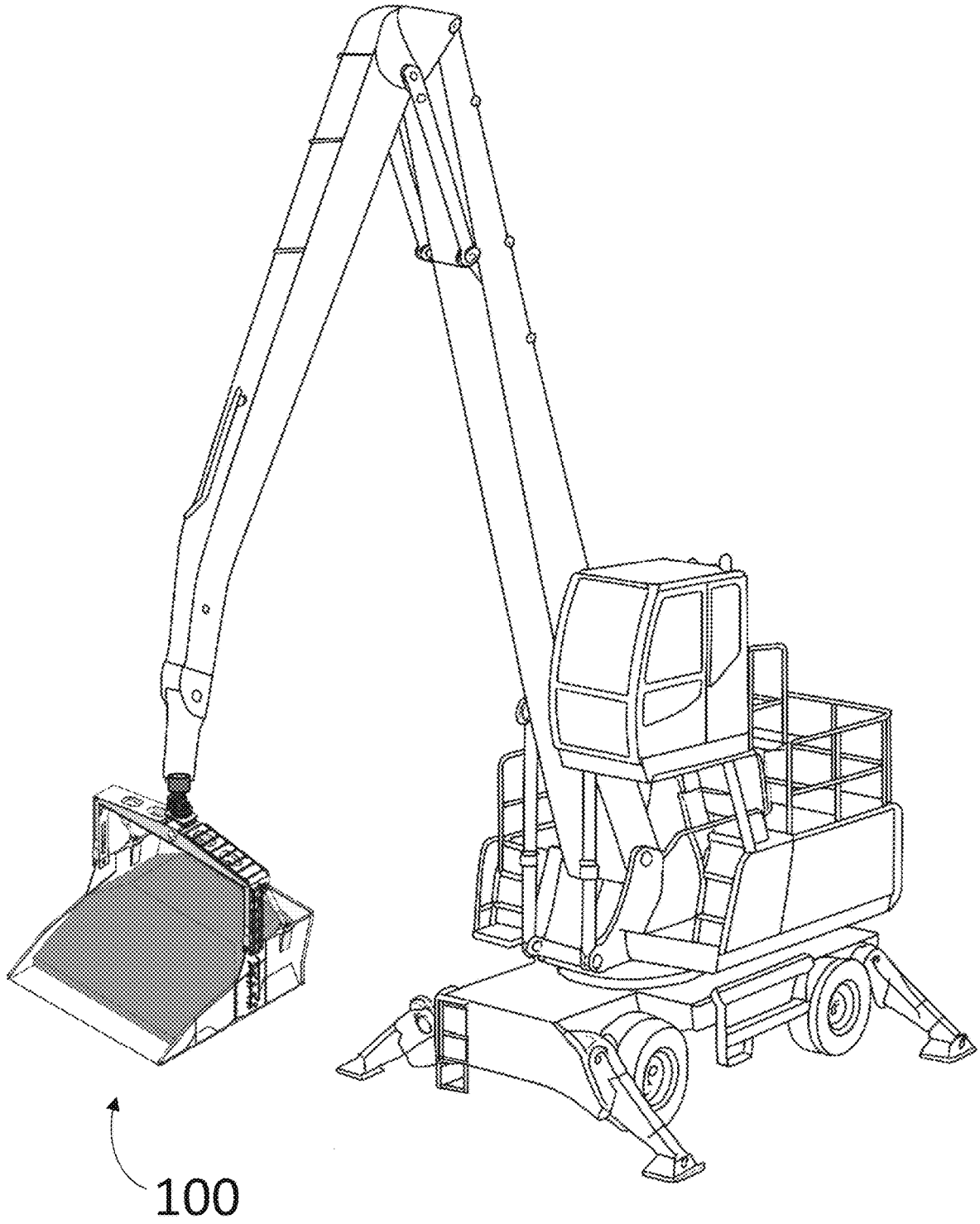
Figure 3:
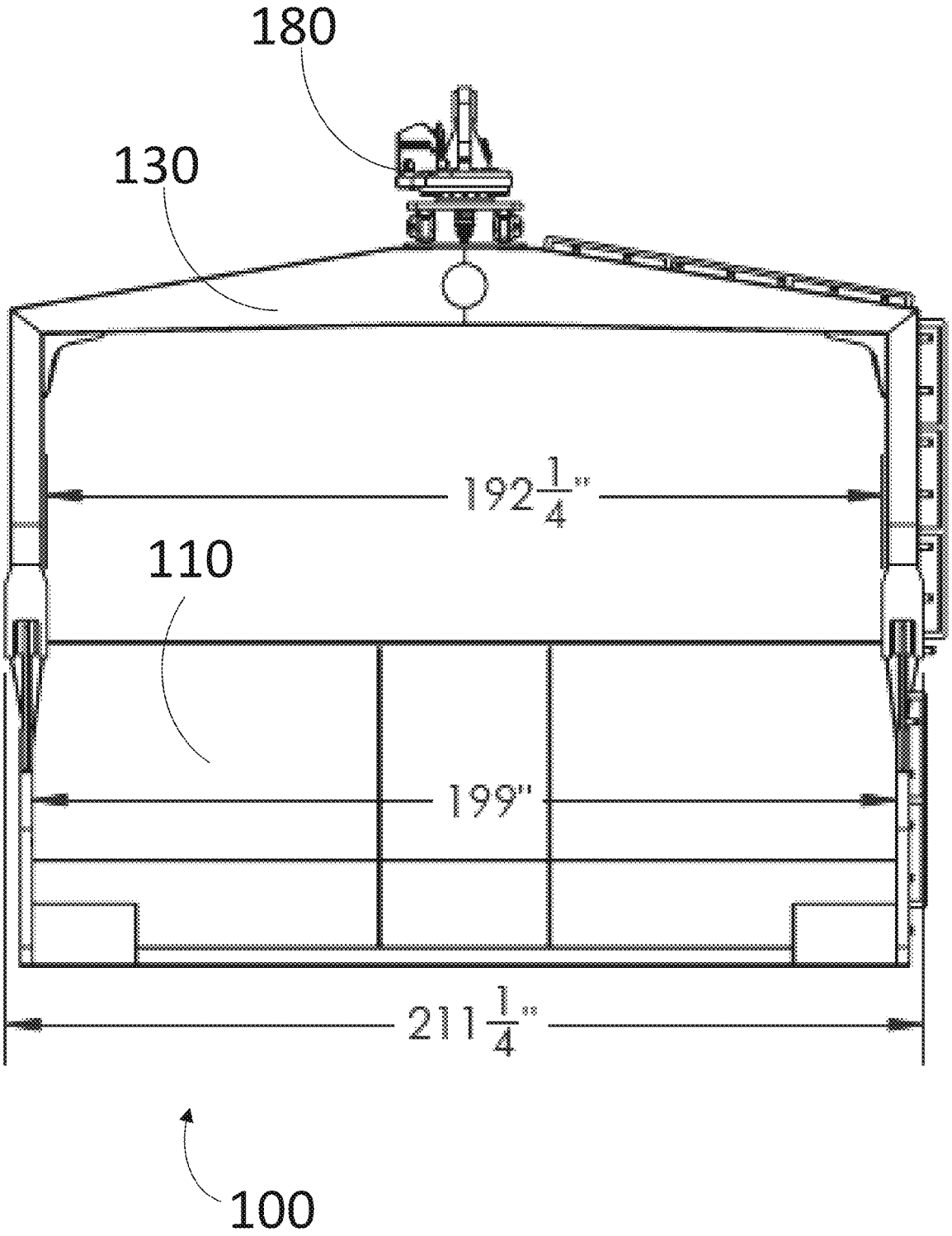
Figure 4:
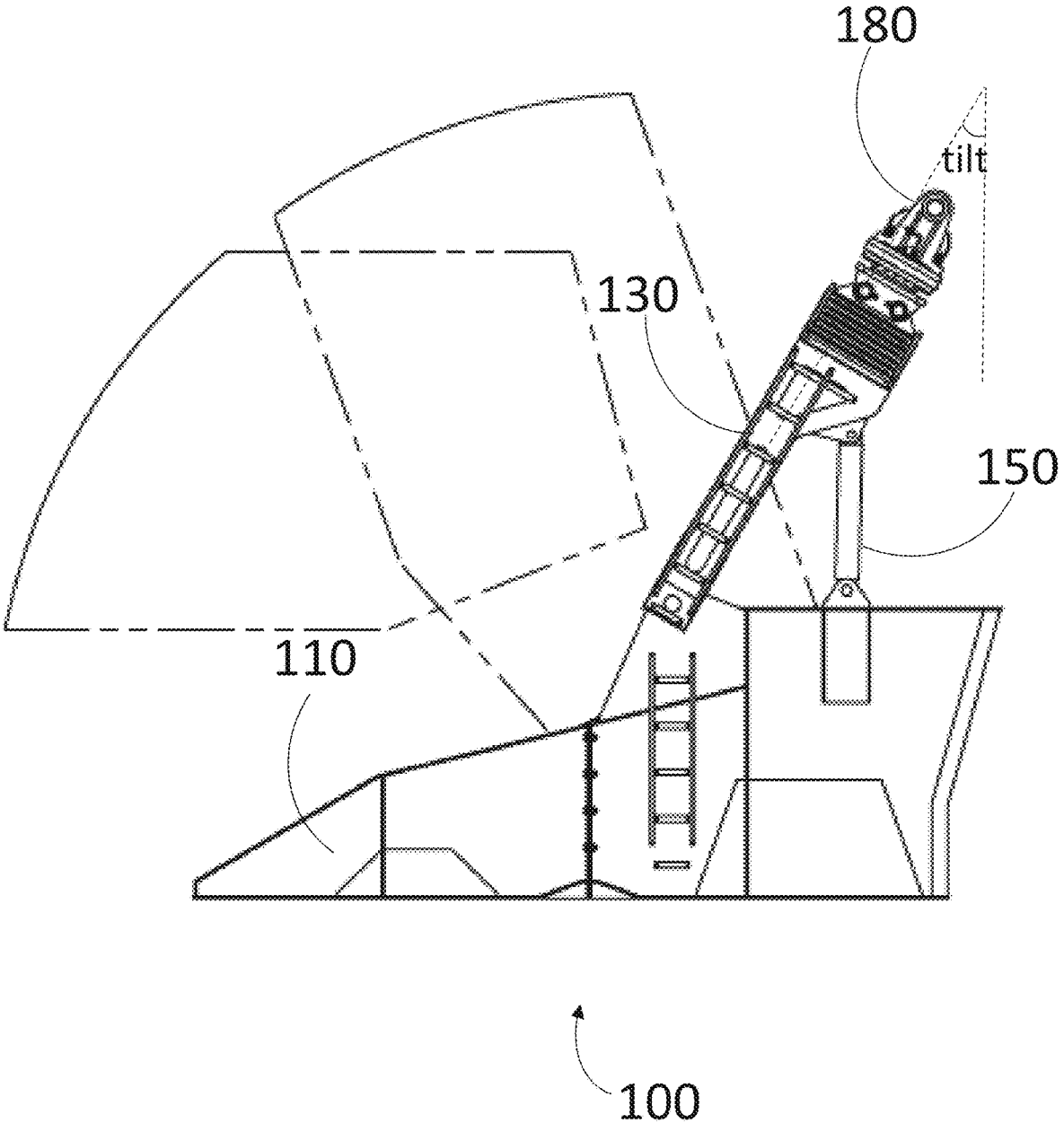
Figure 5:
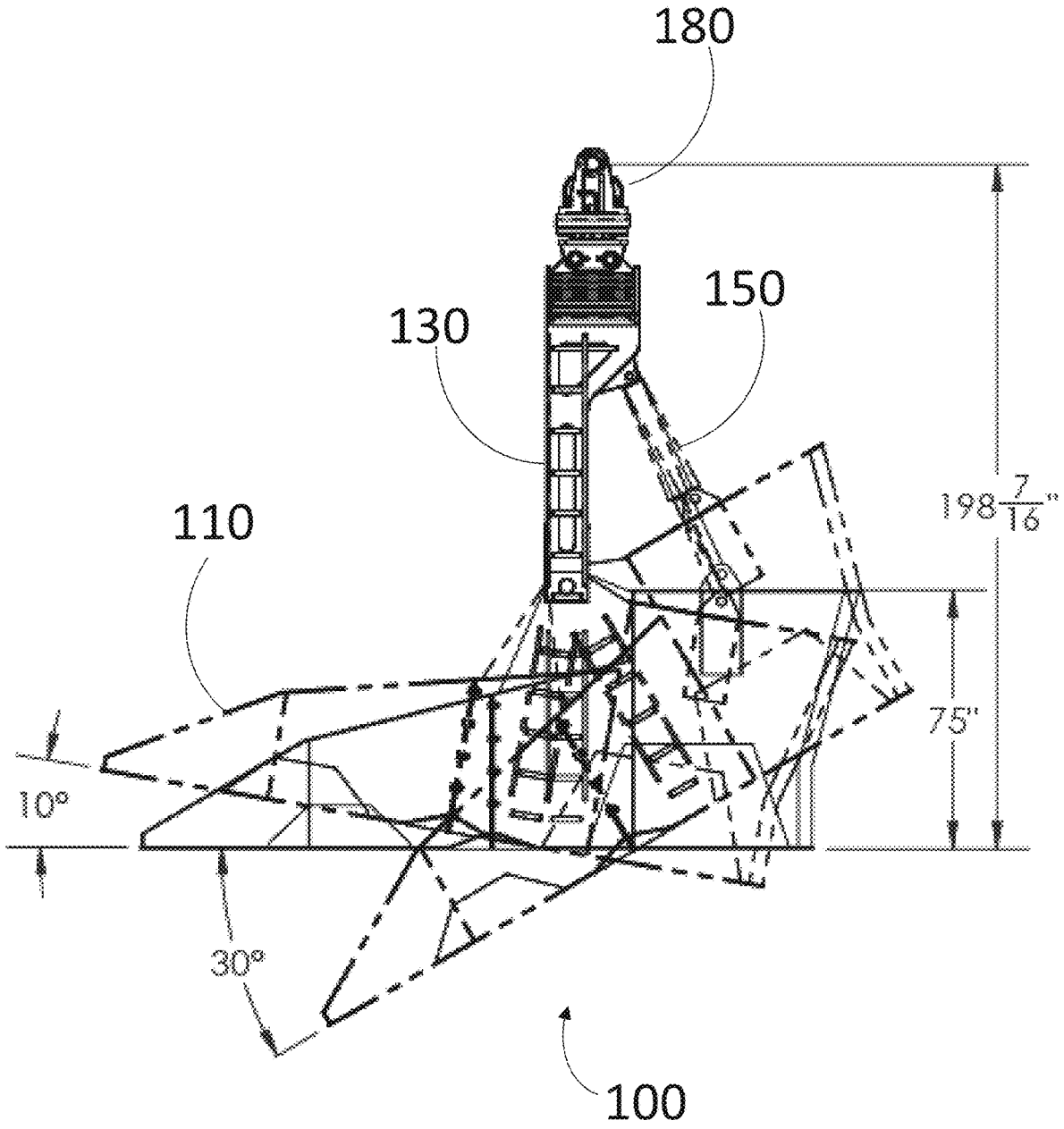
Figure 6:
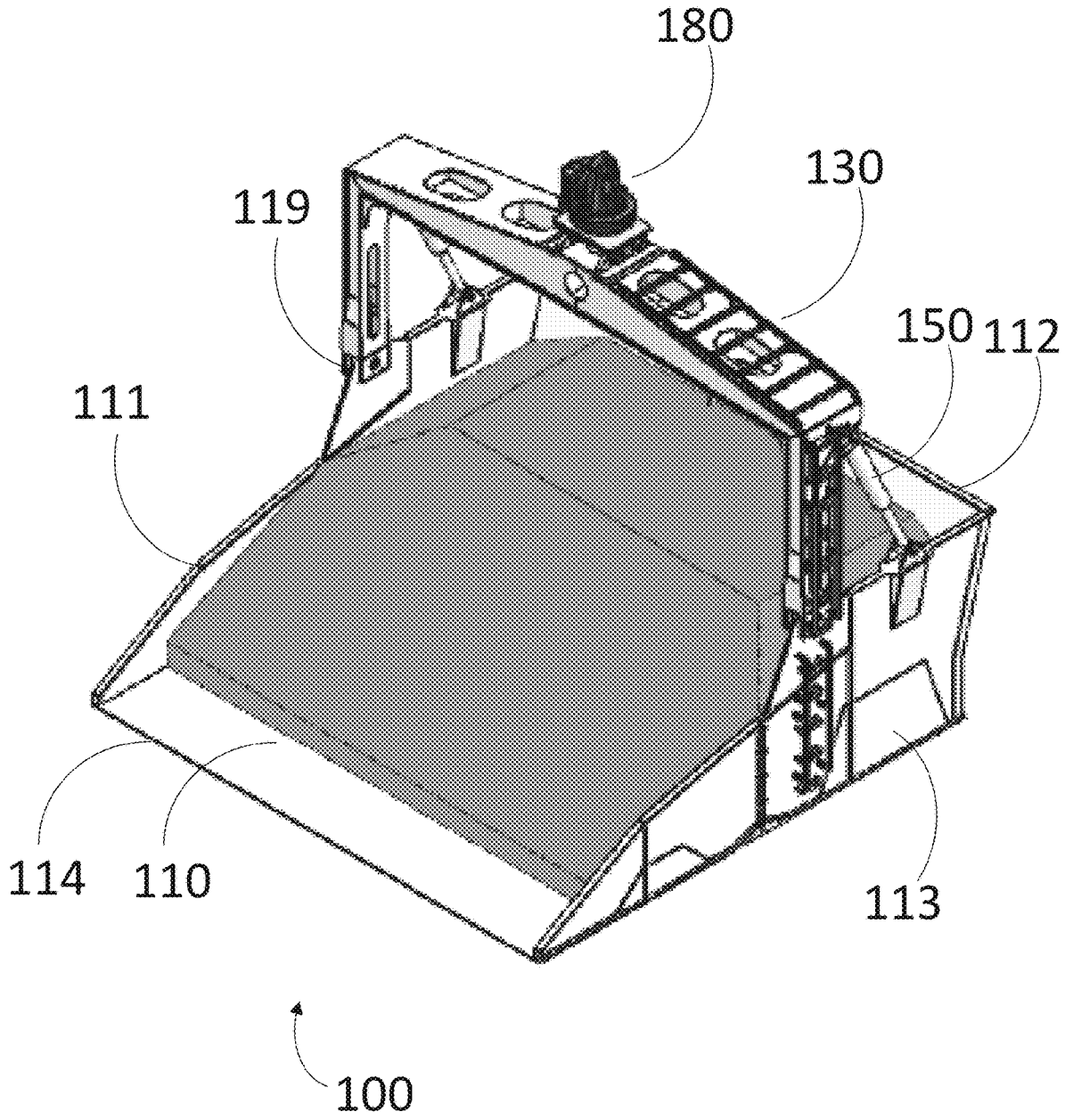
Figure 7:
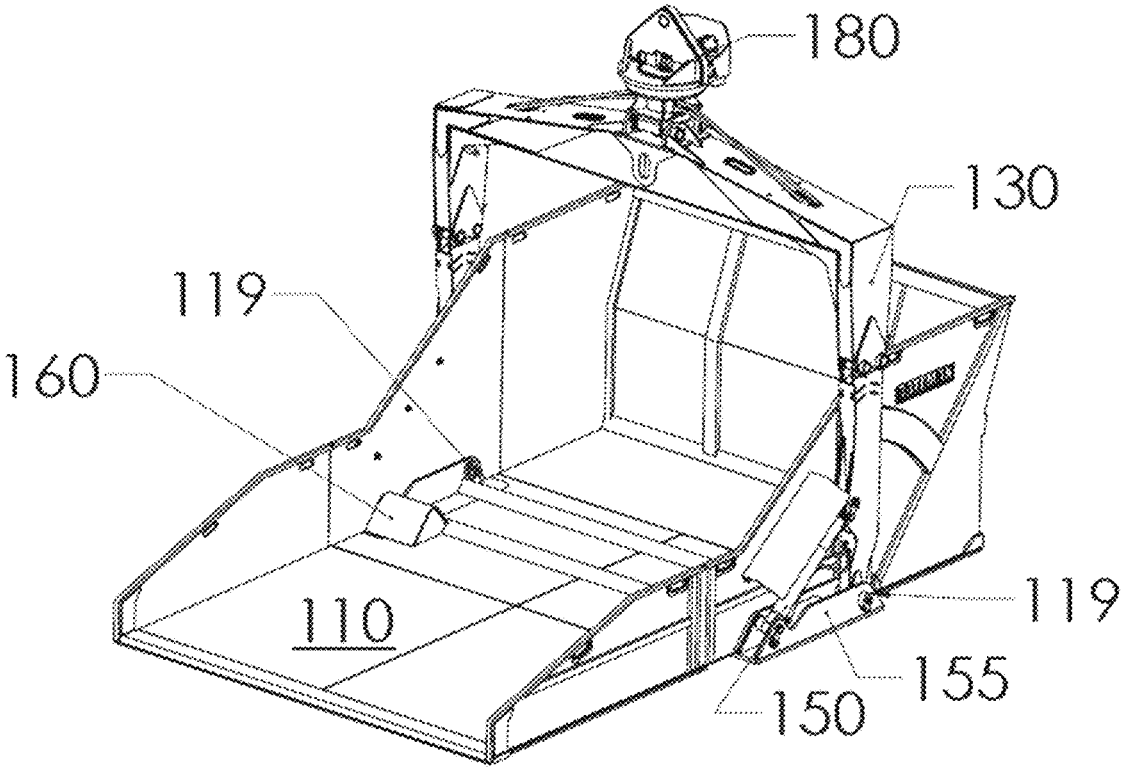
Figure 8:
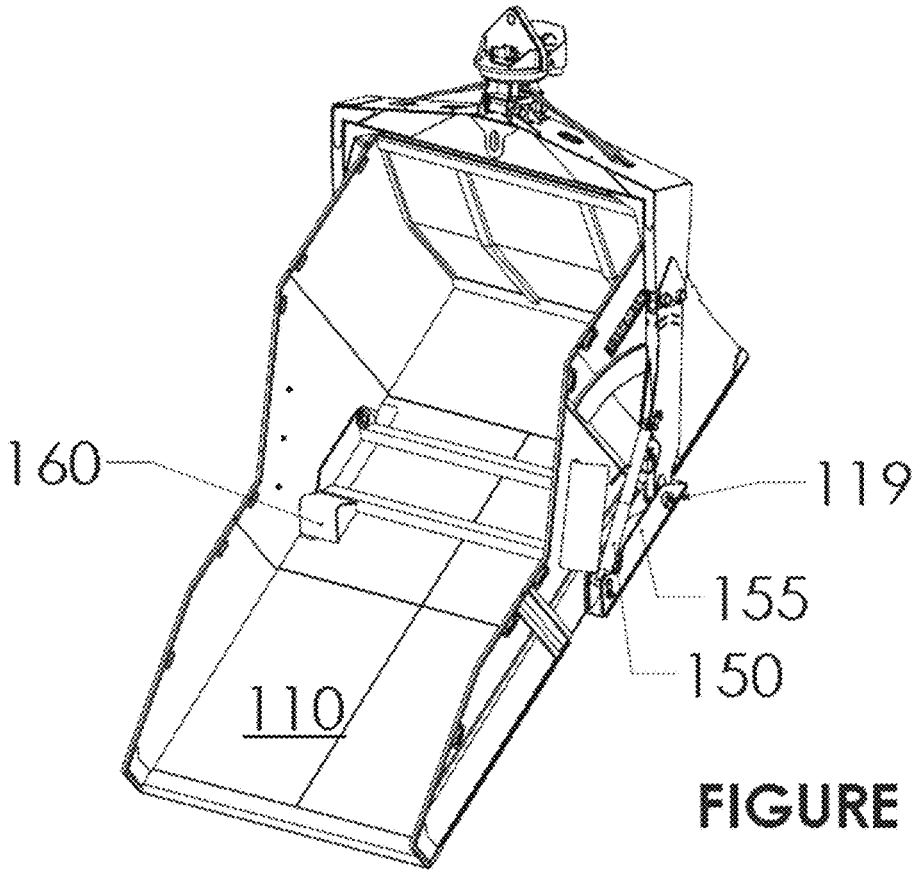
Figure 9:
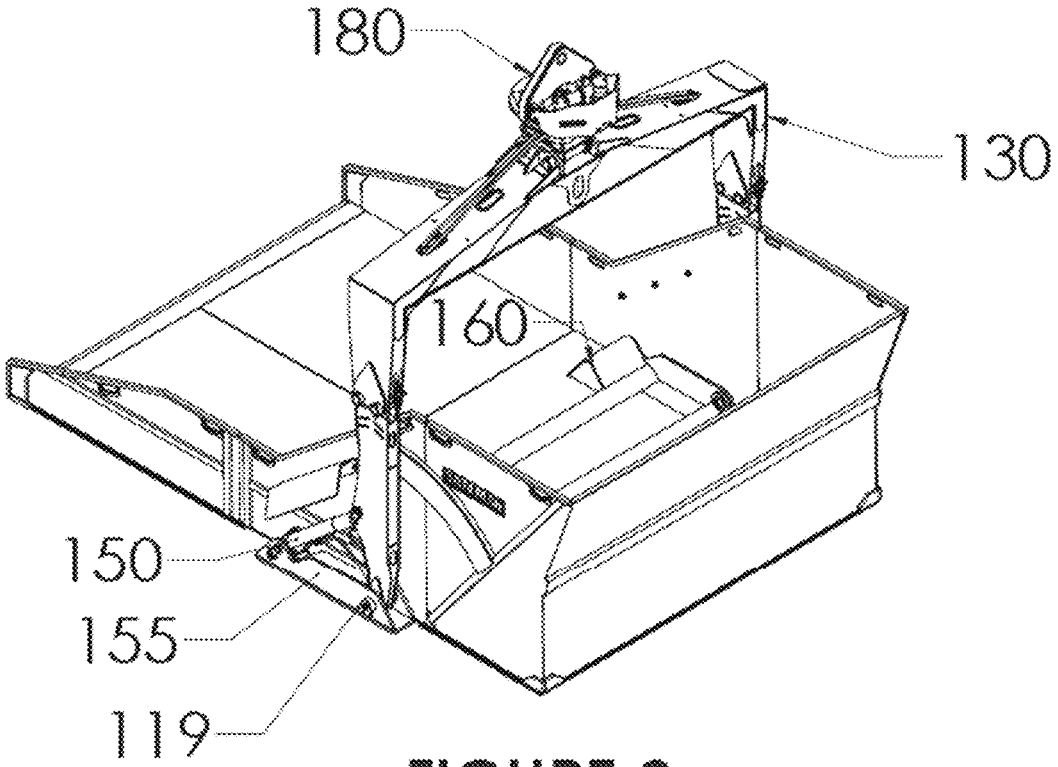
Figure 10:
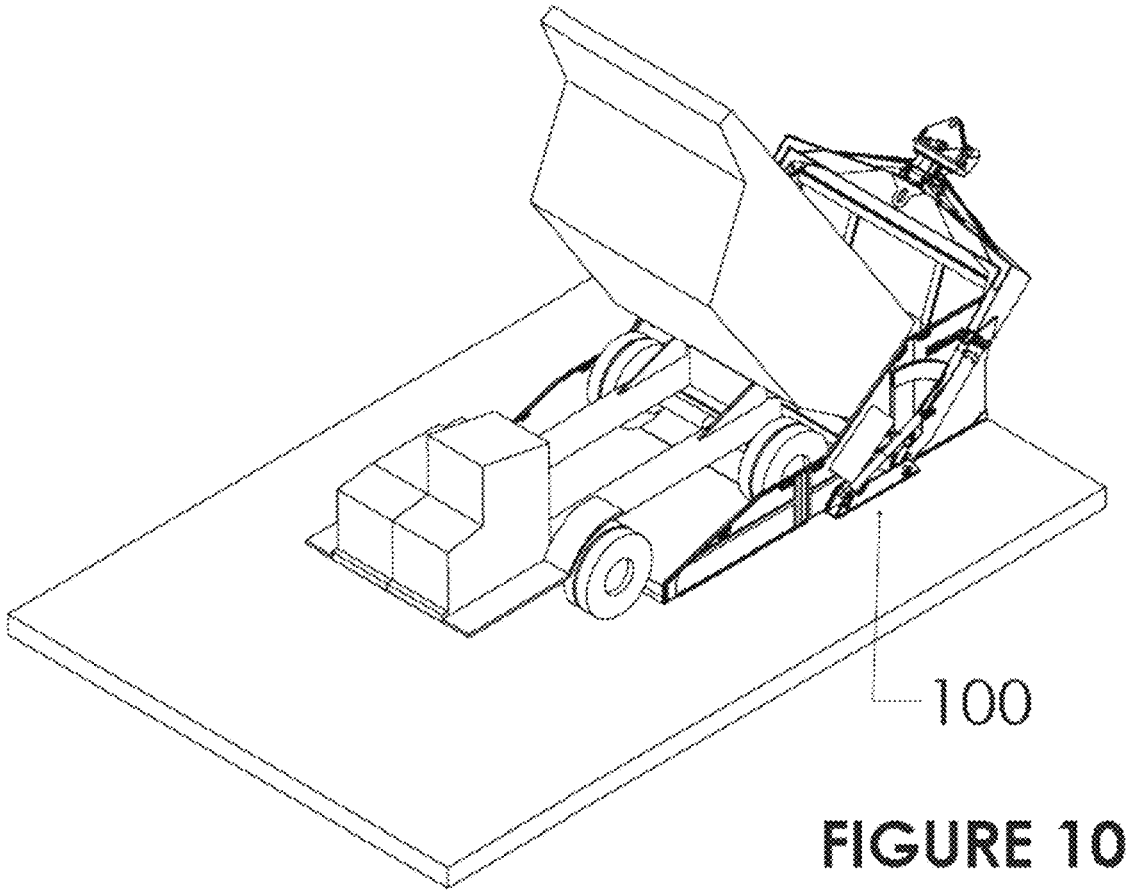

Further features and advantages of the present disclosure will become apparent from the following detailed description, taken in combination with the appended drawings, in which:

FIG. 1 is a perspective view illustrating a material handler with a grapple, according to the prior art;

FIG. 2 is a perspective view illustrating a material handler with a rotatable skip pan as an implement, according to an embodiment of the invention;

FIG. 3 is a front view illustrating a e skip pan with exemplary dimensions, according to an embodiment of the invention;

FIG. 4 is a side view illustrating a rotatable skip pan with the connecting portion and bridge being tilted and the base of the skip pan undergoing a corrective counter-balancing inclination to remain horizontal, according to an embodiment of the invention;

FIG. 5 is a side view illustrating a range of inclination of the rotatable skip pan provided by hydraulic cylinders dedicated to such an inclination, according to an embodiment of the invention;

FIG. 6 is a perspective view illustrating a rotatable skip pan implement, according to an embodiment of the invention;

FIG. 7 is a perspective view illustrating a rotatable skip pan implement, according to another embodiment of the invention;

FIG. 8 is a perspective view illustrating the rotatable skip pan implement as in FIG. 7, where the actuator performs a relative inclination between the base and the bridge;

FIG. 9 is a rear perspective view illustrating the rotatable skip pan implement as in FIG. 7, according to another embodiment of the invention; and FIG. 10 is a perspective view illustrating a rotatable skip pan implement as in FIGS. 7-9, with a truck abutting thereonto for loading the rotatable skip pan implement, according to another embodiment of the invention.

It will be noted that throughout the appended drawings, like features are identified by like reference numerals.

DETAILED DESCRIPTION

There is described below a skip pan 100 for handling materials. In particular, the skip pan 100 as described is particularly well adapted and useful for receiving steel scrap and similar types of material (e.g., metal scrap in general, or loose parts forming the contents of any suitable type of material to be held in the skip pan 100). More specifically, the skip pan 100 as described below is very well adapted for receiving said materials, for undergoing a displacement in space (including translation of the whole skip pan 100 and rotation along various axes over itself) while keeping proper balance for greater safety when handling materials, and discharge or dump the materials in a dedicated location.

Loose piles of material may need to be loaded onto a boat and unloaded therefrom in another location. The skip pan 100 as described herein is especially useful for ship loading tasks, in which the truck unloads the materials directly into the skip pan 100, and where the skip pan 100 is then moved in a controlled and safe manner (according to the invention) over an unloading location of a ship or similar destination, where the skip pan 100, after having been kept in a horizontal configuration during the trajectory (thanks to a vertical spinning axis which can be tilted and an independent hydraulic inclination mechanism as described below) can be inclined to unload its content by gravity into said unloading location.

According to an embodiment, and as shown in FIG. 2, the skip pan 100 is an implement or attachment to be secured at a distal end of a crane, which can be seen as a replacement for the grapple according to the prior art (discussed above). In particular, said crane can be of the type known as a material handler, such as the Sennebogen™ material handlers using in ports, for example the 895 model as shown in FIG. 2. Such an implement or attachment can be detached and reattached to the same crane or to another crane, or to any other suitable type of machine for handling material comprising an arm at the end of which the skip pan 100 can be releasably secured for operation.

Alternatively, according to another embodiment, the skip pan 100 can be integral to such a crane or material handler.

According to an embodiment, the skip pan 100 comprises a main body or base 110 which is substantially flat and which receives materials to be handled. The main body or base 110 is substantially flat and thereby extends as a surface onto which the materials to be handled can be laid. (Some geometrical features, such as low-height steps or bumps, or localized bumps, may exist, as long as the base 110 can act as a floor to receive contents during an appropriate period of time and without impeding proper unloading of the skip pan). Said surface of the main body or base 110 which is substantially flat is the surface which should be kept substantially horizontal when it is displaced. The horizontality of the surface is relative to gravity, since the horizontality of the surface is required to have the contents to be handled remain thereon without sliding away under the effect of their own weight (gravity). The main body or base 110 is substantially continuous over its surface (i.e., no significant holes or openings) to act as a floor for the contents and avoid said contents to drop through the base 110.

Walls 111, 112 and 113 form a walled contour of the flat portion of the base 110 (i.e., the portion of the contour having walls), typically in which there is one edge left free of any wall to ensure that materials can slide away for unloading the skip pan 100. The wall 112 is opposed to said free edge and an be the highest of the walls. Walls 111 and 113 are side walls. Other shapes are possible as the base 110 does not need to be rectangular, i.e., there can be more than three walls forming the contour as long as there is a contour having a wall for keeping the materials therein and the remainder of the contour is a free edge without a wall for allowing materials to slide away from the base 110. A remainder of the contour (other than the portion of the contour having walls) can comprises a wall-less edge for easy loading and unloading of the contents, where said wall-less edge should be kept at least as high than the rest of the surface of the base 110 during transportation of the contents to ensure that the contents do not slide away from this surface.

According to an embodiment, an abutment 160, as shown in FIG. 7-9, is provided for receiving the rear part of the truck which unloads into the skip pan 100, such that the truck operator knows, from the impact with said abutment which can be felt by the mechanical impact from within the truck, that a proper position has been reached and the truck can then be unloaded into the skip 100 to load the skip pan 100 with the transferred contents. This configuration of the truck moving rearwardly and having a portion thereof (e.g., rear tires) abutting on the abutment 160 is well shown in FIG. 10. The abutment 160 can be formed by bumps, or protrusions, which protrude upwardly from the otherwise flat surface of the base 110, and which can be close to the side walls 111, 113 and spaced apart from a distance which correspond, for example, to a distance between tires of the truck (vehicle width) which is to enter rearwardly into the skip pan 100.

According to an embodiment, the rotative skip pan 100 has a holding volume of between about 15 and about 40 cubic meters ($m^3$), preferably between about 20 and about 35 $m^3$, more preferably between about 25 and about 30 $m^3$, for example about 27 $m^3$. Preferably, it weighs less than 9 tons and can hold up to 21 tons of materials, such as steel scrap.

The skip pan 100 has a base 110 of a rectangular shape (without limitation, as it is an example and other shapes can be contemplated) of about 26 feet by 16 feet. The free, open edge, also herein referred as the wall-less edge 114 of the base 110 (the edge without any wall) is large enough to accommodate the width of a truck unloading thereinto (including oversize trucks). Exemplary dimensions are shown in FIG. 3. This wall-less edge 114 ends in an open fashion without any wall which implies that contents from within the skip pan 100 could unobstructively slide from this wall-less edge 114 if the skip pan 100 is inclined such that this wall-less edge 114 is lowered (i.e., lower than the opposite side with the edge 112).

According to an embodiment, there is provided a bridge 130 which connects to the side walls 111, 113 (but could be any opposed portions of the walls forming the walled contour of the base 110). The connection between the lower distal ends of the inverted, U-shaped, bridge 130 and the side walls 111 and 113 is not a rigid, static connection; it is rather a pivotal connection, or hinge 119, in that it can allow pivotal movement of said side walls 11, 113 with respect to the arms of the bridge 130. However, said bridge 130 is rigidly connected to the connecting portion 180, described below, which in turns provides axial rotation (spinning) in relation to the structure above (such as the arm of a crane) holding the connecting portion 180.

According to an embodiment, the top portion of the skip pan 100 comprises a vertical axis, defined by the connecting portion 180 which secures to the distal end of the arm of the came or material handler. Such a connecting portion 180 comprises a mechanism for rotation, such as a gear, which can be exposed, and internally, a ball bearing movement around an axis or any similar mechanism, which an actuator operably connected to a controller, for performing a rotation (spinning movement) of the bridge 130 and eventually of the whole skip pan 100 along this central, longitudinal vertical axis of the connecting portion 180. The controller, to be placed anywhere appropriate in or on the skip pan 100 or even remote from the skip pan with a communication link in between, can control an actuation of the inclination of the base of the skip pan to counteract any tilt applied from the material handler on the top portion of the skip pan 100 such that the base 110 remains horizontal despite the application of an overall tilt from above the skip pan 100.

According to an embodiment, the skip pan 100 is to be mounted as an attachment (or otherwise forming an integral end) of a crane or other material handler having a hydraulic actuation system to provide actuation of all rotation mechanisms. The hydraulic actuation can comprise tubing which passes through the connecting portion 180 into the skip pan 100 to provide actuation of the inclination of the base 110.

The rotation, or spinning movement, is applied to the bridge 130 below, thereby spinning the whole skip pan 100 with respect to the crane or arm holding the bridge 130 via the connecting portion 180. The rotation can be performed all around a circle (360° rotation), and preferably in a continuous manner.

This vertical axis of rotation of the connecting portion 180 can be tilted by tilting the connecting portion 180, thereby titling the bridge 130 altogether and eventually the whole skip pan 100 therealong in the tilting movement (unless the base 110 is conjunctly actively inclined in an opposite direction to cancel said overall tilt of the skip pan 100 driven from the connecting portion 180), everything being held together in a specific position in a controlled manner. This overall tilt is typically provided by the crane operator who tilts the arm of the crane or other type of material handler.

FIG. 4 shows an example in which the vertical axis of rotation of the connecting portion 180 is tilted, with the overall tilt driven via the connecting portion 180 being indicated in the figure. In FIG. 4, there is further applied, in a controlled manner, an inclination by inclination hydraulic cylinders 150 to cancel said tilt, which ensure that even though the bridge 130 is tilted by tilting the vertical axis of rotation of the connecting portion 180, the base 110 of the skip pan 100 remains in a controlled orientation, in this case in surface of the base 110 extending in a horizontal position (not tilted with respect to a horizontal level despite the tilt of the bridge 130), thanks to the inclination applied in conjunction by said inclination hydraulic cylinders 150 to counterbalance the tilt of the connecting portion 180 and bridge 130. This is why the lower, distal end of the arms of the inverted U-shaped bridge 130 should be pivotally connected to the side walls 111, 113 of the base 110.

According to an embodiment, the inclination hydraulic cylinders 150 can comprises a left hydraulic cylinder connecting as a hinge with the left side-wall 111 and a right hydraulic cylinder connecting as a hinge with the right side-wall 113. According to another embodiment, there can be a single hydraulic cylinder connecting with a hinge on one side or with the rear wall 112. According to another embodiment, there can be more than two cylinders. According to another embodiment, the actuator may comprise other types of mechanical forces to apply the actuation that provides the inclination of the base 110, such as a pneumatic engine, an electrical engine, cables under tension being pulled, or any other suitable actuator (electromagnetic, etc.).

The hinge 119 should provide a hinge movement of rotation around an axis which is a hinge axis, which is shown as a dotted line in FIG. 7. The hinge axis can be parallel to the wall-less edge 114 to provide the inclination of the base 110 toward said wall-less edge 114 to lower it down and unload, or away from said wall-less edge 114 to avoid the contents sliding from this edge (keep the base 110 in a horizontal configuration or inclined further away from the horizontal in the other direction of inclination of the base 110 with the wall-less edge 114 being held higher that the rest), such that the inclination drives the contents away from the wall-less edge 114, perpendicularly from the line of the wall-less edge 114 (and also perpendicularly from the hinge axis parallel to that wall-less edge 114). The hinge axis can be perpendicular to the vertical axis at the connecting portion 180 at the top portion of the bridge 130.

According to an embodiment, and as shown in FIG. 5, the inclination of the base 110 applied by said inclination hydraulic cylinders 150 with respect to the bridge 130 can reach between 10° above the horizontal to about 30° below the horizontal.

To perform the inclination of the base 110 with respect to the vertical axis defined by the rotative connecting portion 180, the inclination hydraulic cylinders 150 can advantageously connect at a first end thereof to the bridge 130 (e.g., a respective one of the lower arms thereof, for example, as shown in FIG. 7-9) and, at the other (second) end thereof, to one of the walls forming the contour of the base 110, such as the side walls 111, 113. This second end of the inclination hydraulic cylinders 150 (or any other type of actuator) can also be pivotally secured on a side portion 155 as shown in FIG. 7-9, which is either integral with the base 110 or with the side walls 111, 113, either solidly secured thereto, for example by welding or soldering. Each end of the inclination hydraulic cylinders 150 (or any other type of actuator) should be pivotally connected to the arms or other respective portion of the bridge 130 and to a respective portion of the base 110 or side walls 111, 113 or side portion 155, and therefore include appropriate connecting elements to provide this pivotal connection (e.g., a pin through a bore and any similar arrangement).

According to an embodiment, there are two inclination hydraulic cylinders 150, identical and symmetrically provided on either side of the skip pan 100. For each one, the first end pivotally connects to a portion of the bridge 130, either on the upper horizontal portion of the bridge, the corresponding (right or left) lower vertical arm of the bridge, or the junction of both, as shown in FIG. 5 and FIG. 4. The second end thereof also pivotally connects to a wall for example to a corresponding side wall (111 or 113), as shown in FIG. 6, or to the rear wall 112 of the skip pan 100. The inclination hydraulic cylinders 150 can be actuated using hydraulic fluid with controlled pressure to extend or retract such that the length between the first and the second end thereof is lengthened (extended) or shortened (retracted), thereby providing the required change in orientation (inclination) between the base 110 and the bridge 130, as well shown in FIG. 5.

According to an embodiment of the disclosure, inside the connecting portion 180, there is provided a hydraulic collector, which receives fluid and distributes it for use by hydraulic mechanisms, and an electric connector which provides electric power as well as provides controls for the inclination and rotation of the skip pan 100. The connecting portion 180 should therefore provide the passage of such elements therethrough. The electric power can be used to power inclinometers in the skip pan 100 which measure the inclination thereof, from which feedback is to be provided by the controls to actuate the inclination hydraulic cylinders 150 to counterbalance any other external movement such as the crane arm tilt and rotation. The combination of the rotation (spinning) of the connecting portion 180 and bridge 130 and the inclination of the base 110 with respect to the bridge 130 by the inclination hydraulic cylinders 150 provides the necessary means for counterbalancing any other external movement and keep the skip pan 100, i.e., the base 110, balanced and horizontal at all times unless it is not required. For example, horizontal balance of the base 110 is not required at the time of unloading, in which case the inclination hydraulic cylinders 150 can be actuated to incline the base 110 to lower the wall-free edge and have the contents slide away.

The skip pan 100 as described can be handled (i.e., displaced and rotated according to various axes) vey fast, while keeping balance of the base thereof, which means that the operation is much safer for everyone. While tilting the skip pan 100 with an overall tilt, a tilt-cancelation inclination can be applied to the base 110 to keep its surface horizontal to have the contents remain therefore safely and not slide away, for example not slide away to the wall-less edge 114. The final inclination of the base 110 may be used to unload and thereby slide the contents away using this wall-less edge 114.

The implement or attachment means that it can be used on modern cranes, electrical equipment, or other modern material handlers, which can be well maintained and are safe to use. The use of a pan instead of a grapple also ensures that the risk of dropping materials is reduced, being thereby safer and more eco-friendly.

The design and manufacture of such a skip pan 100 could be a game-changer for loading recycled material or other materials such as metal scrap into ships or other similar tasks. In addition, the material handling machines offer features that, combined with the proposed rotary skip pan 100 as described, will offer unprecedented production performance while being safe and minimizing the impact on the environment compared to current practice.

The skip pan 100 as herein described also utilizes the full volume capacity of the shore crane, reducing the number of cycles for a given task, thereby saving fuel, reducing the cost of operation and being less resource-consuming, which is more environmentally friendly.

While preferred embodiments have been described above and illustrated in the accompanying drawings, it will be evident to those skilled in the art that modifications may be made without departing from this disclosure. Such modifications are considered as possible variants comprised in the scope of the disclosure.

The invention claimed is:

1. A skip pan for handling materials comprising:

a base of the skip pan for containing the materials and having a portion of a contour thereof having walls;

a bridge holding the base and connected at an upper end to a connecting portion for connecting to an arm of a material handler, wherein the connecting portion is rotatable along a vertical axis thereof to provide a spinning movement to the skip pan; and an actuator to provide an adaptable inclination of the base of the skip pan with respect to the bridge to keep the base balanced when the connecting portion is tilted, wherein the actuator comprises a left hydraulic cylinder connecting between the bridge and a left-side wall of the base, and a right hydraulic cylinder connecting between the bridge and a right-side wall of the base.

2. The skip pan of claim 1, wherein a remainder of the contour of the base of the skip pan has a wall-less edge.

3. The skip pan of claim 2, wherein the actuator provides the adaptable inclination of the base of the skip pan which moves the wall-less edge up or down.

4. The skip pan of claim 3, wherein the base of the skip pan has a surface for containing the materials which is flat and continuous.

5. The skip pan of claim 4, wherein the base of the skip pan has a contour with four sides, comprising the left-side one of the walls of the base, the right-side walls of the base, a rear wall together forming said contour of the base having walls, a front side of the base forming the remainder of the contour of the base of the skip pan and being the wall-less edge.

6. The skip pan of claim 5, wherein the bridge has a reverse U shape with lower arms connected with the base of the skip pan and forming a hinge connection therewith.

7. The skip pan of claim 6, wherein there are two lower arms of the bridge, each connected to a respective one of the left-side walls of the base, and the right-side walls of the base and forming a hinge connection therewith.

8. The skip pan of claim 6, wherein the hinge connection has a hinge axis which is substantially parallel with the wall-less edge.

9. The skip pan of claim 8, wherein the hinge axis is substantially perpendicular to the vertical axis of the connecting portion at the upper end of the bridge.

10. The skip pan of claim 9, wherein the left hydraulic cylinder and the right hydraulic cylinder extend from an upper portion of the bridge to a portion of the base of the skip pan which is away from the hinge connection in a direction perpendicular to the hinge axis of the hinge connection to provide the adaptable inclination of the base of the skip pan with respect to the bridge around the hinge axis of the hinge connection.

11. The skip pan of claim 1, wherein the connecting portion at the upper end of the bridge comprises at least one of: hydraulic tubing and electrical connection passing therethrough to power the actuator of the skip pan.

12. The skip pan of claim 1, further comprising a controller which controls the actuator to provide an adaptable inclination of the base of the skip pan with respect to the bridge to keep the base balanced when the connecting portion is tilted by the arm of a material handler.

13. A skip pan for handling materials comprising:

a base of the skip pan for containing the materials and having a portion of a contour thereof having walls;

a bridge holding the base and connected at an upper end to a connecting portion for connecting to an arm of a material handler, wherein the connecting portion is rotatable along a vertical axis thereof to provide a spinning movement to the skip pan; and an actuator to provide an adaptable inclination of the base of the skip pan with respect to the bridge to keep the base balanced when the connecting portion is tilted, wherein the base of the skip pan comprises side bumps forming an abutment for corresponding portions of a truck to stop a truck entering into the skip pan at a position defined by said abutment.

14. The skip pan of claim 13, wherein a remainder of the contour of the base of the skip pan has a wall-less edge.

15. The skip pan of claim 14, wherein the actuator provides the adaptable inclination of the base of the skip pan which moves the wall-less edge up or down.

16. The skip pan of claim 15, wherein the base of the skip pan has a contour with four sides, comprising a left-side one of the walls of the base, a right-side one of the walls of the base, a rear wall together forming said contour of the base having walls, a front side of the base forming the remainder of the contour of the base of the skip pan and being the wall-less edge.

17. The skip pan of claim 16, wherein the bridge has a reverse U shape with lower arms connected with the base of the skip pan and forming a hinge connection therewith, wherein there are two lower arms of the bridge, each connected to a respective one of the left-side one of the walls of the base, and the right-side one of the walls of the base and forming a hinge connection therewith.

18. The skip pan of claim 17, wherein the hinge connection has a hinge axis which is substantially parallel with the wall-less edge, wherein the hinge axis is substantially perpendicular to the vertical axis of the connecting portion at the upper end of the bridge.

19. The skip pan of claim 18, wherein the actuator comprises cylinders that extend from an upper portion of the bridge to a portion of the base of the skip pan which is away from the hinge connection in a direction perpendicular to the hinge axis of the hinge connection to provide the adaptable inclination of the base of the skip pan with respect to the bridge around the hinge axis of the hinge connection.

20. The skip pan of claim 13, wherein the actuator comprises a hydraulic cylinder connecting between the bridge and a respective one of the walls of the base, further comprising a controller which controls the actuator to provide an adaptable inclination of the base of the skip pan with respect to the bridge to keep the base balanced when the connecting portion is tilted by the arm of a material handler.

* * * * *